United States Patent [19]

Kozacka et al.

[11] 4,166,266

[45] Aug. 28, 1979

[54] ELECTRIC FUSE HAVING COMPOSITE SUPPORT FOR FUSIBLE ELEMENT

[75] Inventors: Frederick J. Kozacka, South Hampton; Richard A. Belcher, Hampton Falls, both of N.H.

[73] Assignee: Gould Inc., Rolling Meadows, Ill.

[21] Appl. No.: 883,810

[22] Filed: Mar. 6, 1978

[51] Int. Cl.[2] ..... H01H 85/04; H01H 85/38

[52] U.S. Cl. ..... 337/158; 337/273; 337/276

[58] Field of Search ..... 337/158, 159, 160, 161, 337/162, 280, 281, 273, 274, 276, 279, 282, 290, 293; 29/623

[56] References Cited

U.S. PATENT DOCUMENTS

| | | | |
|---|---|---|---|
| 2,667,549 | 1/1954 | Fahnoe et al. | 337/158 |
| 3,573,699 | 4/1971 | Salzer | 337/293 |
| 3,599,138 | 8/1971 | Kozacka | 337/276 |
| 3,881,161 | 4/1975 | Kozacka | 337/161 |
| 3,925,745 | 12/1975 | Blewitt | 337/273 |
| 4,093,932 | 6/1978 | Kozacka | 337/159 |
| 4,099,156 | 7/1978 | Salzer | 337/290 |

*Primary Examiner*—Harold Broome
*Attorney, Agent, or Firm*—Erwin Salzer

[57] ABSTRACT

An electric fuse having a support for the helically wound fusible element or elements. The support includes a plurality of rod-like supports each made of one uniform material. Some of the plurality of rod-like supports consist solely of a non-gas-evolving material, while at least one of the plurality of rod-like supports consists solely of a gas-evolving material.

8 Claims, 5 Drawing Figures

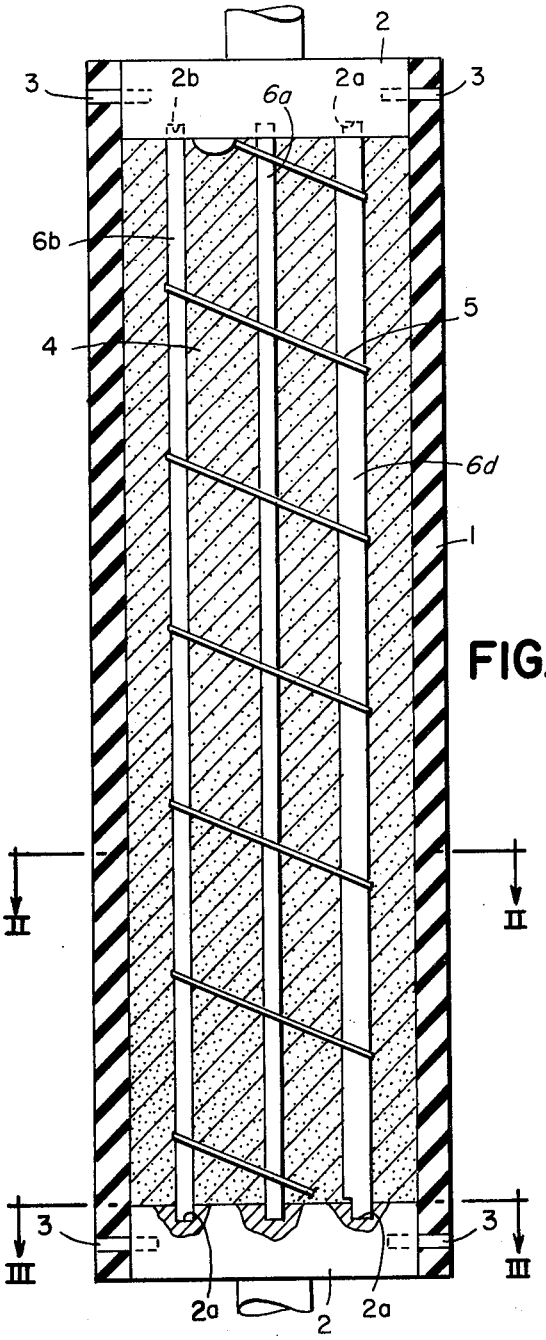
FIG. 1
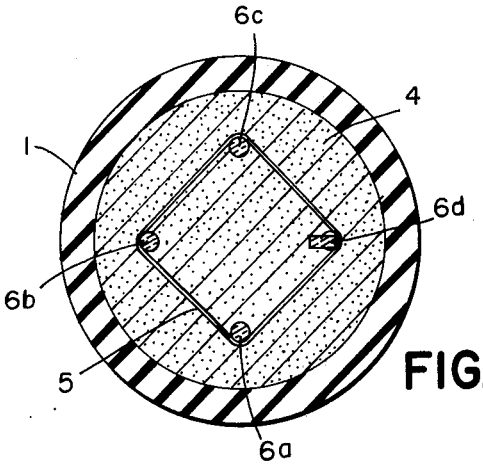
FIG. 2
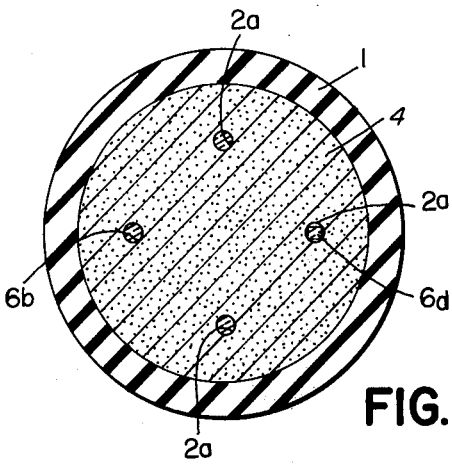
FIG. 3
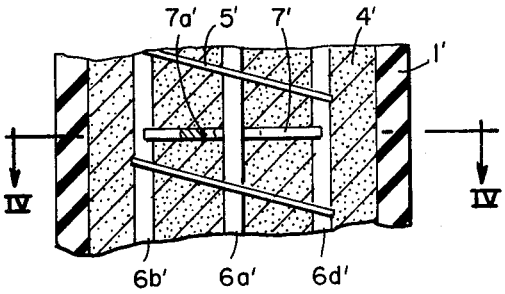
FIG. 5
FIG. 4
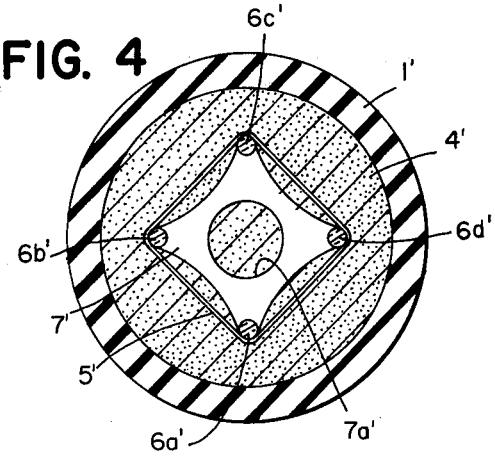

ELECTRIC FUSE HAVING COMPOSITE SUPPORT FOR FUSIBLE ELEMENT

BACKGROUND OF THE INVENTION

A large number of prior art designs were evolved to support helically wound fusible elements of fuses intended for elevated voltages. One support of relatively recent date is shown in U.S. Pat. No. 3,599,138 to Frederick J. Kozacka, 08/10/71 for HIGH-VOLTAGE FUSE. The fusible element support shown in that patent consists of a laminate of glass-cloth and melamine resin, which is a material that evolves gas under the action of electric arcs. On high fault currents gas-evolving fusible element supports sometimes evolve an excess of gas, as a result of which the fuse casing must be reinforced, if bursting thereof is to be avoided.

U.S. Pat. No. 3,925,745 to Donald D. Blewitt, 12/09/75 for HIGH VOLTAGE FUSE WITH LOCALIZED GAS EVOLVING SUPPRESSORS eliminates the drawbacks of prior art designs. According to that patent the supporting rods for the fusible element are made of a non-gas-evolving substance and are provided with inserts of a gas-evolving substance. Gas evolution is, therefore, limited to the aforementioned inserts or suppressors.

The above design is, however, still subject to limitations. One of these limitations resides in the fact that there is no freedom of varying the pitch of the fusible element or elements without, at the same time, varying the position of the gas-evolving inserts or suppressors. Another limitation of the above design resides in the fact that each supporting rod comprises two materials, a non-gas-evolving substance and a gas-evolving substance. The fabrication of fusible element supporting rods of several materials weakens the strength of the rods, and greatly increases the manufacturing cost of a fuse whose fusible element, or elements, are supported by such rods, i.e. the manufacturing cost of a fuse as a whole.

The present invention eliminates the limitations to which fuses manufactured under U.S. Pat. No. 3,925,745 are subject.

SUMMARY OF THE INVENTION

Electric fuses embodying the present invention include a tubular casing of electric insulating material, a pair of electro-conductive terminal elements each arranged at one of the ends of said casing and closing said casing, a pulverulent arc-quenching filler inside said casing, a substantially helically wound fusible element submersed in said filler and conductively interconnecting said pair of terminal elements, and a support for said fusible element. Said support for said fusible element includes a plurality of rod-like support elements arranged in spaced relation parallel to the longitudinal axis of said casing.

According to the present invention each of said plurality of rod-like support elements is made of one uniform material, and some of said plurality of rod-like support elements consist solely of a non-gas-evolving material, while at least one of said plurality of rod-like supporting elements consists solely of a gas-evolving material.

BRIEF DESCRIPTION OF THE DRAWINGS

FIG. 1 is mainly a longitudinal section of a fuse embodying the present invention;

FIG. 2 is a section along II—II of FIG. 1;

FIG. 3 is a section along III—III of FIG. 1;

FIG. 4 is a section along IV—IV of FIG. 5 of a modification of the structure of FIG. 1; and FIG. 5 shows substantially in vertical section that portion of the fuse shown in FIG. 4.

DESCRIPTION OF PREFERRED EMBODIMENT

Referring now to the drawings, and more particularly to FIGS. 1–3 thereof, numeral 1 has been applied to indicate a tubular casing or housing of electric insulating material of a fuse for elevated voltages, say a few kilovolts. A pair of terminal elements in the form of terminal plugs 2 are arranged at the ends of housing 1, each at one of the ends thereof. Steel pins 3 project through housing 1 into electroconductive plugs 2. Thus housing 1 is firmly closed by plugs 2 and pins 3. A pulverulent arc-quenching filler 4, e.g. quartz sand, is provided inside of housing 1. Numeral 5 has been applied to indicate a substantially helically wound fusible element, e.g. of sheet silver. Instead of one fusible element the fuse shown in FIGS. 1–3 may include several such elements having the same pitch and connected in parallel. A support for fusible element 5 includes a plurality of rod-like support elements *6a, 6b, 6c, 6d* arranged in spaced relation parallel to the longitudinal axis of casing or housing 1. Fusible element 5 is wound around rod-like elements *6a, 6b, 6c* and *6d* substantially helically in a number of turns. Each of rods *6a, 6b, 6c* and *6d* is made of a uniform material, i.e. either one that is non-gas-evolving under the action of electric arcs, or one that is gas-evolving. Rod-like supporting elements *6a, 6b* and *6c* may consist of a non-gas-evolving substance, and rod-like supporting element *6d* may consist of a gas-evolving substance. Where the evolution of gas is intended to be relatively large, two instead of one of rod-like supports may be of gas-evolving material. Since the presence of gas-evolving material is not limited to the region of physical engagement of fusible element 5 and support *6d*, but extends all the way from one of terminal plugs 2 to the other of terminal plugs 2, the gas-evolving support is preferably made of a non-tracking insulating material. There are many such materials available on the market and, therefore, there is no need for a specific description of such materials. It may be mentioned, however, that satisfactory results can be obtained if support rod *6d*, or two support rods *6b, 6d*, are made of a laminate of glass - cloth and melamine, provided that the interface of fusible element 5 and support rod *6d*, or the interfaces between fusible element 5 and support rods *6b* and *6d*, is kept relatively small.

Terminal plugs 2 are provided with four blind bores *2a* at the axially inner end surfaces thereof. Supporting rods *6a, 6b* and *6c* are cylindrical and project with the ends thereof into blind bores *2a*. Gas-evolving support rod *6d* is rectangular in cross-section to increase the bending strength thereof. Its end may also be inserted into a bore *2a*, or inserted into a radial groove formed in terminal plugs 2. Rod *6d* is arranged in a radial plane and supports fusible element 5 at the radially outer edge thereof.

Rods *6a, 6b* and *6c* are made of a ceramic material and are cylindrical or circular in cross-section. The preferred material for rods 6a,6b and 6c is a high alumina content ceramic.

FIG. 4 shows another means for imparting additional bending strength to the rod of gas-evolving material. As shown in FIG. 4 casing 1' of an electric insulating material is filled with a pulverulent arc-quenching filler 4'. Fusible element 5' is wound helically around rods 6a',6b',6c' and 6d'. Bracing plate 7' having a central aperture 7a' braces rod 6d' of gas-evolving material which has a relatively limited bending strength in comparison to the rods 6a,6b and 6c of a high alumina content ceramic material.

It will thus be apparent that in the structure of FIG. 4 the bracing member 7' has a number of radially extending arms equal in number to the number of said support rods 6a',6b',6c',6d'. Each of said arms engages with the radially outer end thereof one of rods 6a',6b',6c',6d' to transfer bending forces acting upon rod 6d' of gas-evolving material having a relatively limited bending strength to rods 6a',6b',6c' of ceramic material having a relatively large bending strength.

I claim as my invention:

1. An electric fuse for elevated circuit voltages including a tubular casing of electric insulating material, a pair of electro-conductiveterminal elements each arranged at one of the ends of said casing, and closing said casing, a pulverulent arc-quenching filler inside said casing, a substantially helically wound fusible element submersed in said filler and conductively interconnecting said pair of terminal elements, and a support for said fusible element including a plurality of rod-like support elements arranged in spaced relation parallel to the longitudinal axis of said casing, wherein the improvement consists in that each of said plurality of rod-like support elements is made of one uniform material, and that some of said plurality of rod-like support elements consists solely of a non-gas-evolving material, while at least one of said plurality of rod-like support elements consists of a gas-evolving material.

2. An electric fuse as specified in claim 1 having four rod-like support elements of which one consists of a gas-evolving material, and three consist of a non-gas-evolving material.

3. An electric fuse as specified in claim 1 wherein said rod-like support elements which consist of a non-gas-evolving material are cylindrical, and said rod-like support elements which consist of a gas-evolving material are rectangular in cross-section, are arranged in a radial plane of said casing and support said fusible element at the radially outer edge thereof.

4. An electric fuse as specified in claim 1 including a bracing member that transmits bending forces acting upon one or more of said rod-like support elements of gas-evolving material to said rod-like support elements of non-gas-evolving material.

5. An electric fuse including a tubular casing of electric insulating material, a pair of electroconductive terminal plugs arranged at both ends of said casing and closing said casing, a pulverulent arc-quenching filler inside said housing, a substantially helically wound fusible element submersed in said filler and conductively interconnecting said pair of terminal plugs, and a support for said fusible element wherein the improvement comprises a fusible element support including a plurality of rods of a ceramic material, said fusible element support further including at least one additional rod of a gas-evolving material, all said rods being arranged parallel to the longitudinal axis of said casing and having the ends thereof inserted into blind holes provided in said pair of terminal plugs.

6. An electric fuse as specified in claim 5 wherein said rods of a ceramic material are circular in cross-section and said additional rod of a gas-evolving material is rectangular in cross-section.

7. An electric fuse as specified in claim 5 including three rods of a high alumina content ceramic and one single rod of a gas-evolving melamine compound.

8. An electric fuse as specified in claim 5 including a bracing member having a number of radially extending arms equal in number to the number of said plurality of rods of a ceramic material plus one, each except one engaging with the radially outer end thereof one of said plurality of rods of a ceramic material and one engaging with the radially outer end thereof said additional rod of gas-evolving material to transfer some of the bending forces acting upon said additional rod of gas-evolving material having a relatively limited bending strength to said plurality of rods of a ceramic material having a relatively large bending strength.

* * * * *